United States Patent [19]

Siminoff

[11] 4,377,963

[45] Mar. 29, 1983

[54] SELF-CONTAINED MUSICAL STRING CASSETTE

[76] Inventor: Roger H. Siminoff, 112 Privada Luisita, Los Gatos, Calif. 95030

[21] Appl. No.: 287,267

[22] Filed: Jul. 27, 1981

[51] Int. Cl.[3] ..... G10D 3/14

[52] U.S. Cl. ..... 84/297 R; 84/197; 84/200; 84/204; 84/303; 84/304; 84/306; 84/312 R

[58] Field of Search ..... 84/173, 197-208, 84/267, 290, 297 R, 297 S, 303-306, 312 R

[56] References Cited

U.S. PATENT DOCUMENTS

| | | | |
|---|---|---|---|
| 215,486 | 5/1879 | Siedersleben | 84/200 |
| 441,716 | 12/1890 | Tindall | 84/303 |
| 542,719 | 7/1895 | Wahner | 84/297 S |
| 3,834,266 | 9/1974 | Robinson | 84/267 |

*Primary Examiner*—Lawrence R. Franklin

*Attorney, Agent, or Firm*—Gottlieb, Rackman & Reisman

[57] ABSTRACT

A holder or cassette in the form of a spool having wound thereon a string for a musical instrument, is disclosed. The free end of the string is secured to the spool, while the opposite end utilizes the traditional "ball" or loop which is affixed to the tailpiece or bridge of the instrument.

The spool has an axial opening so that it can be mounted over a correspondingly shaped tuning machine shaft, and the spool can also have an internal bar which slips into a slot in the shaft. Musicians can quickly change strings using the invention without the need to actually thread the string through the tuning machine and then cut off the excess as is currently done. Instead, the ball end of the string is inserted into the bridge or tailpiece and a cassette is mounted over the shaft; the tuning machine or peg is then turned in conventional fashion to take up the slack in the string and the instrument is once again ready for use.

53 Claims, 19 Drawing Figures

FIG. 3
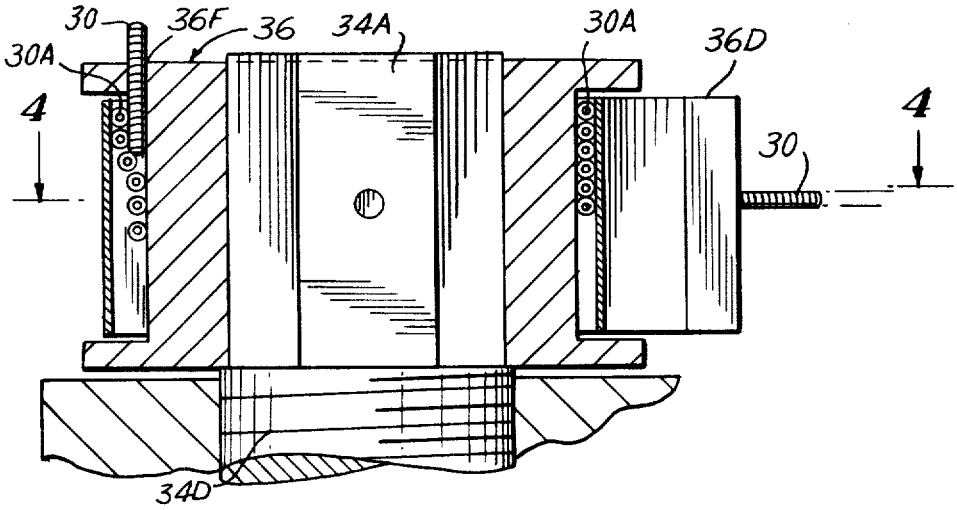
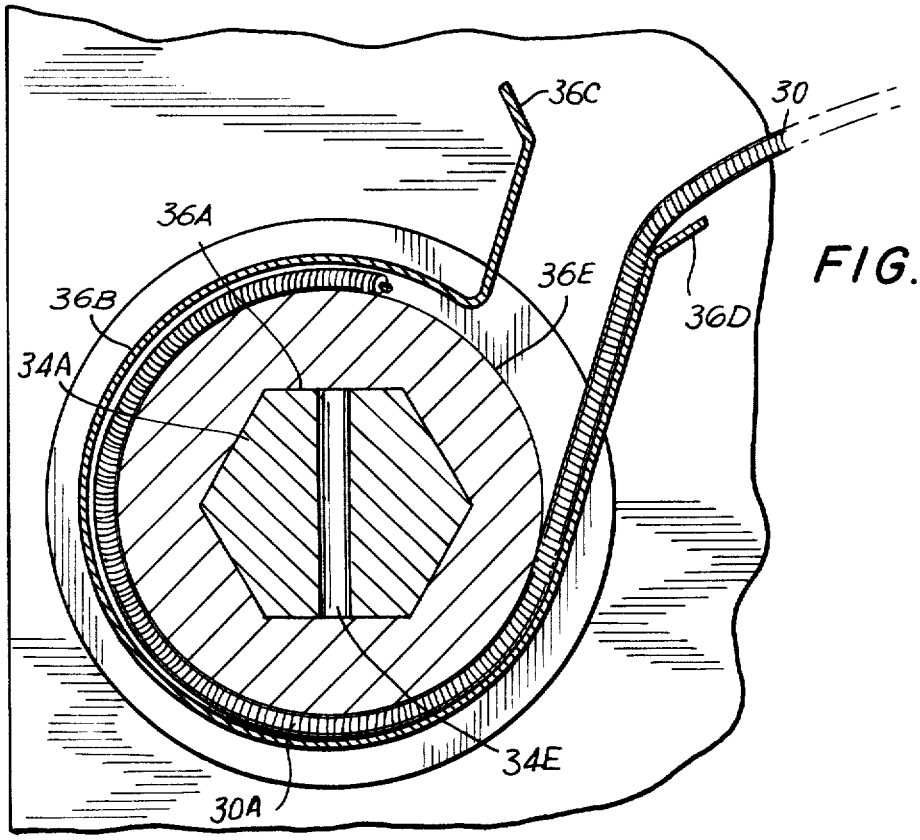
FIG. 4
FIG. 5
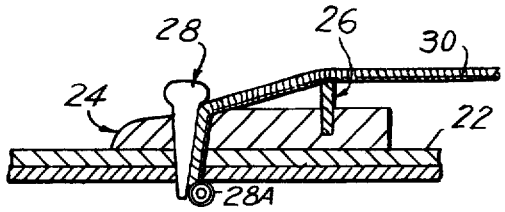

FIG. 10A
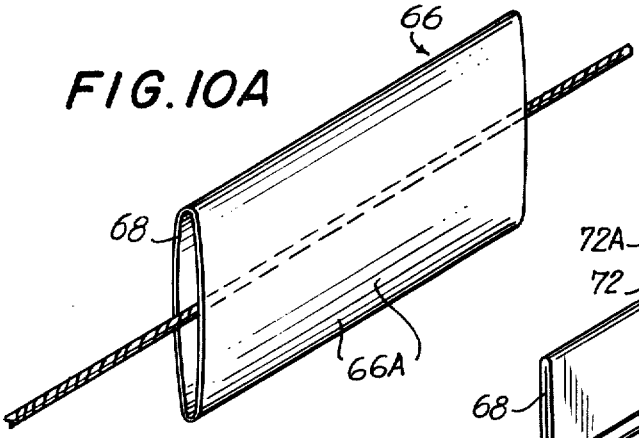
FIG. 10B
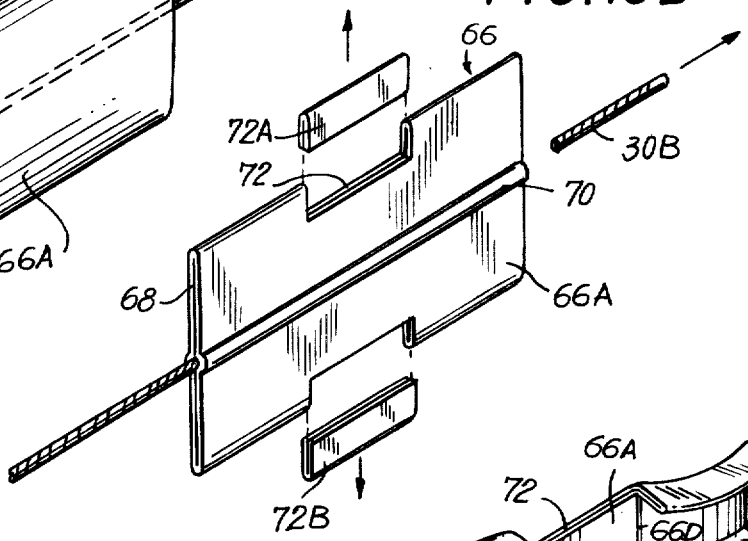
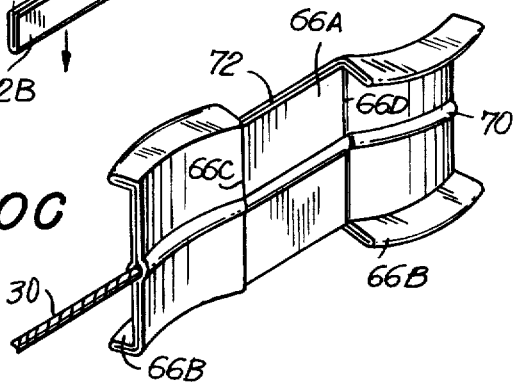
FIG. 10C
FIG. 10D
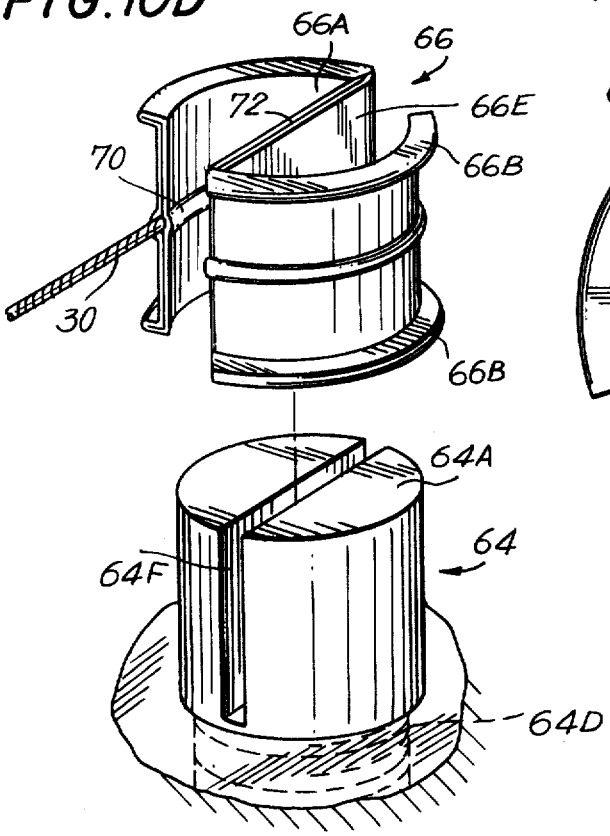
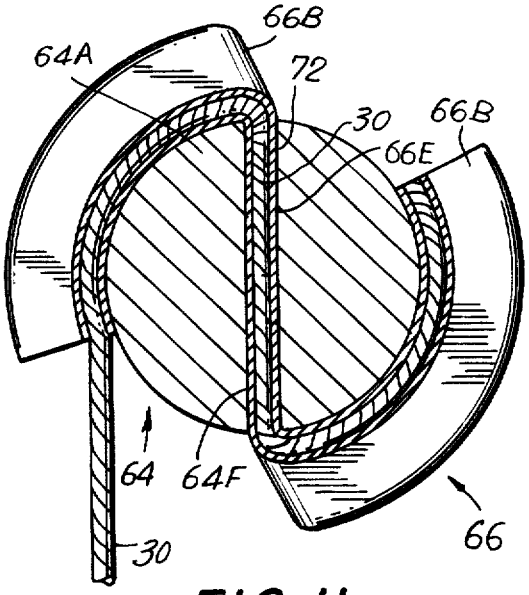
FIG. 11

SELF-CONTAINED MUSICAL STRING CASSETTE

DESCRIPTION

This invention relates to musical instruments in general, and to a new type of string-attaching apparatus for such instruments in particular.

Over the last several years, we have witnessed a great explosion in people seeking out new areas of activity with their leisure time. Of course, there has been the well-known expenditure of time, effort and money in the "do-it-yourself" area, involving crafts, woodworking and similar creative acts. The arts in general and certainly music, photography, painting, sculpture and similar activities, have also received a great deal of attention from many individuals.

Not only has there been a great proliferation of individuals taking up these leisure time activities in general, but there has been a corresponding enlargement of interest and activity on the part of professionals in these fields as well. The musical area is one which has been the focus of much of this attention, with professional musicians and amateurs at home expressing a great deal of interest in every aspect of music and the equipment used to perform music. This has been true both with respect to those who are active in performing music and those who merely listen to music of all kinds, including classical, rock, folk and jazz. In fact, there has been a growing symbiotic relationship in this field, whereby the great popularity of radio stations and recordings which present the different types of music has undoubtedly caused enough interest for many people to take up the actual playing of instruments.

Whether one considers the professional musician or the amateur, most of these people have one thing in common—they wish to play music as quickly and "efficiently" as possible, creating the best tones, sound and overall impressions with the greatest ease of playing. In the area of stringed instruments in particular, the proliferation of interest has been quite intense. Accordingly, much attention has focused on stringed instruments, particularly the guitar, but also on banjos, mandolins and others in this category.

Aside from the many acoustical and tonal variations which can be achieved using different levels of instruments which have different corresponding costs, one of the most time consuming and therefore annoying aspects of playing and maintenance of these instruments is the changing of the strings. In the past, musical strings have been supplied to musicians in long, virtually unmeasured lengths. Typically, the strings were tied onto one end of the instrument, e.g., the bridge or tailpiece, which constituted the fixed end of the string, and then manually unwound toward the tuning end of the instrument. At that end, the string would be twisted one or more times around the tuning peg shaft and then passed through a slot or hole to secure it against slippage during tightening. Of course, any excess string remaining after these steps would have to be coiled up, broken, off, or cut off (if clippers are available), or at least shortened in some manner to avoid interfering with the musician's use of the instrument.

Subsequent to the earliest development of string manufacture, the fixed end of the string was provided with either a loop or a machine turning which consisted of a small sleeve or cylinder which was twisted onto that end of the string and then locked into a slot at the tailpiece or bridge. These latter machine fittings became known as "ball-ends" or simply "balls". Very little has occurred to change the manner in which the fixed end of the string is attached to the tailpiece or bridge—loops or ball ends are used to this very day and do not seem destined to change very much since they are rather satisfactory under the circumstances. But at the other end, where the string must be tailored somewhat to attach to the tuning peg and therefore must be cut to size and then secured, the art has been relatively unsatisfactory in making improvements. Thus, the hand-affixed steel string often slips on the post, and must be twisted on in a special way to avoid slipping. The installation is uncomfortable and often leads to skin punctures from the broken or loose end of the string.

To the extent that the problem has even been addressed at all, the industry has devised apparatuses for storing coiled amounts of string and unwinding them as one desires to install a string and attach it onto the tuning peg. Similarly, other attachment techniques have been used, such as providing both ends of a musical instrument string with the conventional loop, thus making the attachment per se somewhat easier and more convenient. But little or no attention has been paid to the real core of this problem, namely to make a more convenient method of attaching the free end of the string to the tuning peg shaft without at the same time involving the musician in trimming the string or worrying about how the attachment is to take place, whether there will be a sufficient length of string to suit a particular location on the instrument, whether the string attachment will be secure and slip-free, and whether the string installation can be performed without personal injury. For performing artists, strings often break onstage; in conventional metal installations, a few minutes are needed to remove the old string from its twisted and interlocked position, twist on a new string and secure it from slipping.

It is therefore an object of this invention to obviate one or more of the aforesaid difficulties.

It is another object of this invention to permit a musician to readily install a new string on an instrument by having a fixed member attached on one end of the string and a prewound segment on the other without the need for trimming the string.

It is also an object of this invention to have a string contained within a cassette which readily fits over the tuning peg or shaft at the tuning end of a stringed musical instrument.

It is still another object of this invention to devise a fitting which will have universal application to the various shapes of tuning machines currently being used, for the installation of new musical strings. It is a further object of this invention to provide instantaneous and cassette-like installation of a musical string.

Additional objects and advantages will become apparent when considered in conjunction with a particular illustrative embodiment of the invention wherein a string fastening device is presented so that the string can be installed and removed from an instrument quickly and without any need to cut the string to length. This invention utilizes a string having, at the fixed tailpiece or bridge end, the conventional ball or loop. At the other end, however, the string is wound onto a small "cassette" spool. In one embodiment of this invention, the string wound around this spool is held in place by a spring metal clip which encircles substantially all of the spool except for a small "window" created by two projecting lips of the clip. These lips extend outward from the spool and not only allow the clip to slide around the spool during tightening, but permit the other or fixed end of the string to extend outward between them.

The spool has a transverse hole extending through it, the hole being of suitable cross-sectional shape to allow mating with the tuning machine peg. For example, if the tuning machine peg is hexagonal in shape, the hole through the cassette will be hexagonal. In such instances, the spool is dropped down onto the shaft and immediate mating occurs, permitting the turning of the peg to cause the turning of the cassette. As the spool is tightened by the usual turning of the tuning peg shaft, the lips of the surrounding metal clip of the spool contact the string and effectively "slip" around the spool as the spool turns with the shaft. This causes sufficient string, wound within the spool, to be released through the lips of the clip so that unwinding can occur and the string can be tightened in place. In instances where the tuning peg shaft is other than hexagonal or of other polygon shape, an adaptor can be used to accommodate the cassette opening to the shaft.

Various other embodiments are also disclosed as part of the invention. In situations where the tuning machine shaft is a slotted one, the cassette can be formed with a cast or molded crosspiece or bar through its interior cylindrical surface. The cassette is then lowered such that the bar fits within the slot and the same mating as previously discussed takes place. In this embodiment, the string is fixed by having it pass through and be fastened in adjacent holes in one cover or edge flange of the cassette. In a related embodiment, instead of casting or molding a shaft or bar into the cassette, the musical string itself acts as the crosspiece by passing through opposed central apertures on opposite sides of the cassette and then being grasped within a flange hole of the cassette. Then, for particular slotted tuning machine shafts, the lowering of the cassette causes the string itself, passing from one side of the cassette to the other, to fit within the slot and to act as the turning member.

It is therefore a feature of an embodiment of this invention that a cassette spool contains sufficient string wound around its interior shaft to allow for installation of the string at both the fixed and free ends of a musical instrument string in a convenient and prompt fashion.

It is also a feature of an embodiment of this invention that a string cassette is pre-wound with sufficient string to accommodate virtually any musical instrument need, with the cassette being adapted to fit over the tuning machine shaft and being tightened to appropriate playing tightness merely by turning the conventional tuning machine of the stringed instrument.

It is a further feature of an embodiment of this invention that a spring clip surrounds the interior shaft of a string-holding cassette such that the contained string can be unwound as needed in particular lengthening situations to accommodate an instrument's varying needs.

It is still another feature of an embodiment of this invention that a string cassette can be provided with internal crosspieces for string passage portions to fit within underlying slots of the tuning machine shaft to cause turning of the cassette with the tuning machine shaft to wind up the string in particular instances.

It is a further feature of an embodiment of this invention that a musical instrument string can be held in a crimped sleeve cassette, around which is wound a sufficient supply of string to permit the string to be mounted onto a tuning machine shaft without the necessity of trimming or cutting the string to size.

These and other objects, features and advantages of this invention will become more readily understood when considered in connection with a presently preferred, but nonetheless illustrative, embodiment of the invention as explained in the following detailed description and as shown in the accompanying drawing, wherein:

FIG. 3 is a fragmentary and enlarged sectional view of the cassette mounted on the shaft, with the strings surrounding the cassette, taken along the line 3—3 of FIG. 1 in the direction of the arrows;

FIG. 4 is an enlarged and partially broken away sectional plan view of the cassette and shaft, illustrating the string protruding from the metal clip surrounding the cassette spool, taken along the plane indicated at 4—4 of FIG. 3 in the direction of the arrows;

FIG. 5 is a fragmentary view of the bridge or tailpiece end of the instrument, illustrating the attachment of the ball end of the string into the tailpiece, taken along the line 5—5 of FIG. 1 in the direction of the arrows;

Figure 12:
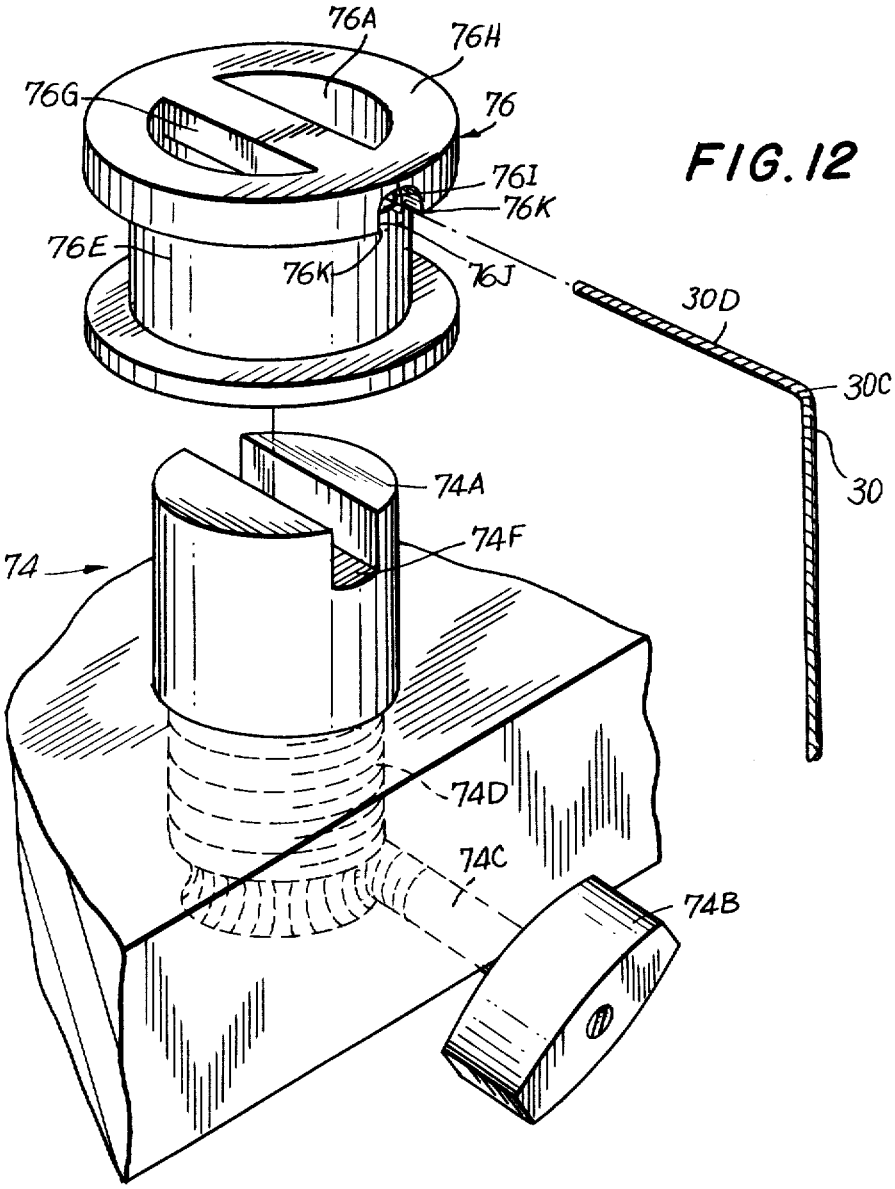
Figure 13:
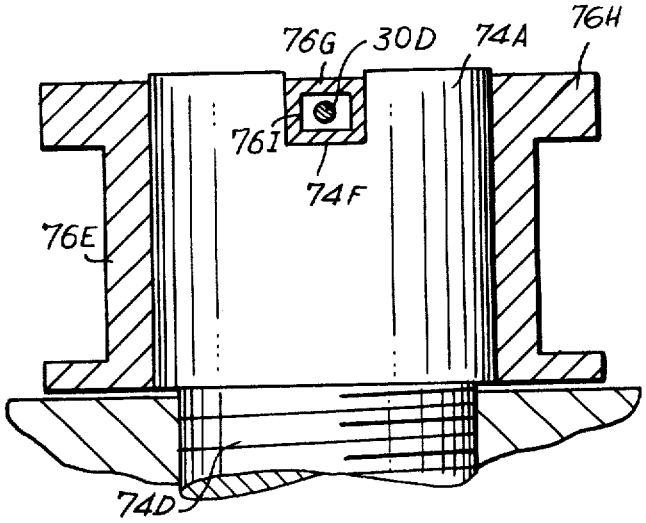
Figure 14:
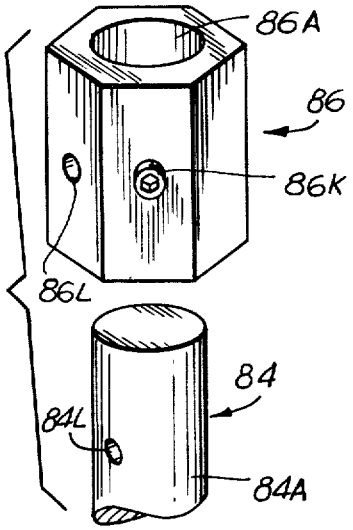
Figure 16:
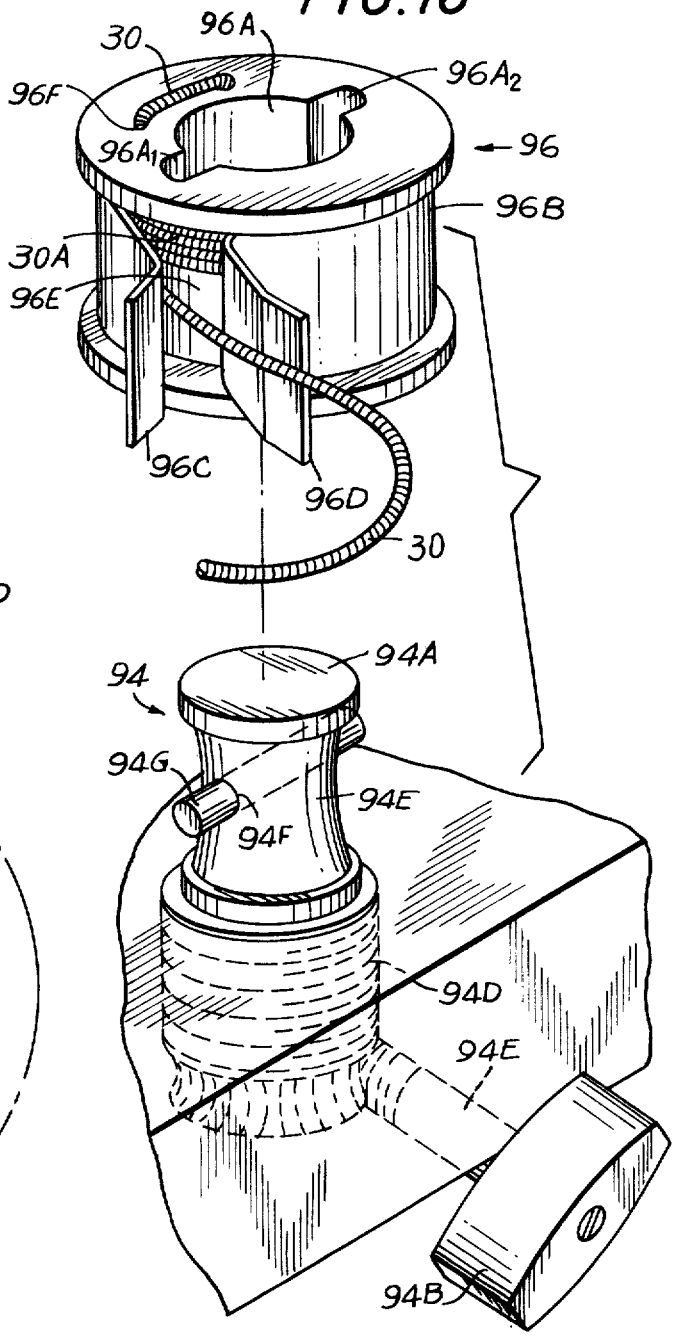
Figure 15:
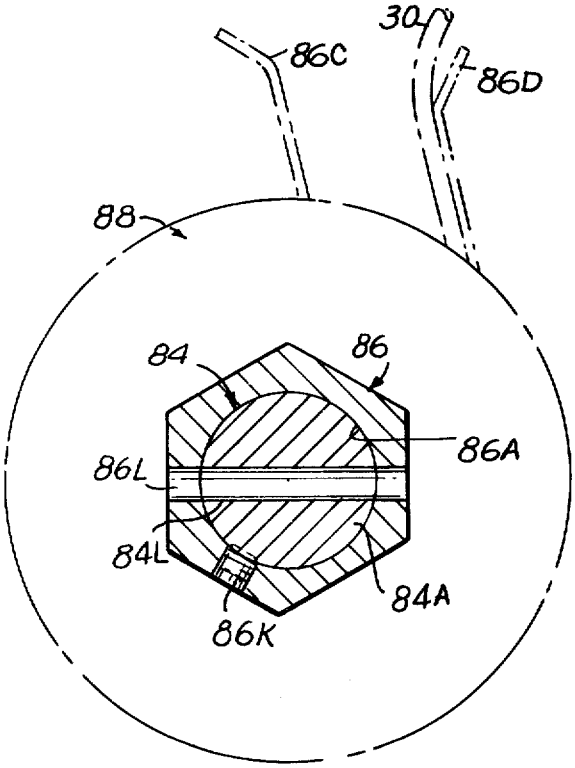

FIGS. 10A–10D illustrate the crimped sleeve embodiment for holding and winding up the string, with FIG. 10A showing the insertion of the string in the sleeve; FIG. 10B showing the crimping of the sleeve around the string and the removal of excess string and two portions of the sleeve to adapt it for bending; FIG. 10C showing the selective bending of end portions of the sleeve; and FIG. 10D showing the formation of the Z-shaped member containing the string, for lowering into the underlying slotted peg;

FIG. 11 is a top sectional view through the shaft and Z-shaped sleeve of FIG. 10 showing the two elements interconnected;

FIG. 12 is a fragmentary perspective and exploded view of an embodiment in which the string is bent and is inserted within a bore through a crosspiece in the cassette spool, the crosspiece being adapted to provide turning torque by coupling with the underlying slot of the tuning machine shaft;

FIG. 13 is a side sectional view of the embodiment of FIG. 12 showing the string, the bore and the crosspiece occupying its position within the underlying slot;

FIG. 14 illustrates an adaptor or collar capable of being mounted over a cylindrical tuning machine shaft;

FIG. 15 is a partial top plan view showing the mounting of the hexagonal collar over the underlying cylindrical shaft of FIG. 14; and FIG. 16 is an exploded perspective view, partly broken away, showing the use of a particular embodiment of the cassette spool having opposed vertical slots adapted to mate with a transverse pin which passes through the underlying tuning machine shaft.

Figure 1:
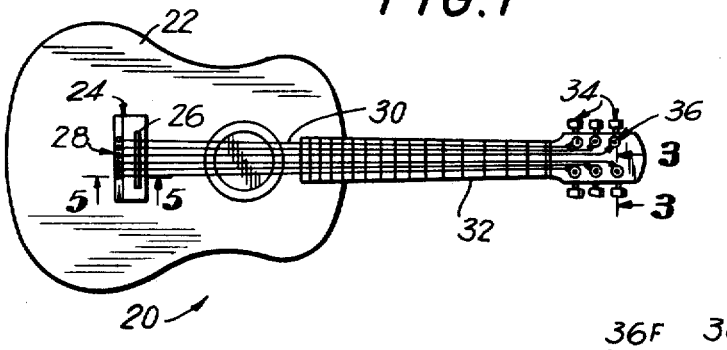
FIG. 1 shows a top plan view of a typical stringed instrument, namely a guitar, on which the device of this invention has been installed on the six tuning machines corresponding to six strings of the instrument.

The general illustration of a guitar given in FIG. 1 indicates the manner in which this invention can be applied to such an instrument. (The invention has equal application to other stringed instruments as well, such as banjos, mandolins, basses and the like.) The overall guitar 20 of FIG. 1 is provided with a main body portion 22 having mounted thereon a bridge or tail piece section indicated generally at 24. Such bridge or tail piece has an underlying support member 26 over which strings 30 travel to the fastening end region 28. As indicated heretofore in the general description, strings used for guitars and other similar instruments have conventionally been provided with a "ball" end 28A, consisting of a small cylindrical machine turning illustrated, for example, in FIGS. 1 and 5. This cylindrical member is inserted on the opposite side of a slot in tail piece 24, thereby fixing a stationary position for one end of string 30. The string is then drawn towards the opposite end of the instrument, to be described hereinafter, with tension being held along the string. It is also possible that this fixed end of the string will be held in place by a loop and peg arrangement, which is also conventional, but which is not illustrated herein.

After the ball end 28A has been affixed to tail piece 24 in the essentially conventional manner indicated above, the string 30 proceeds over support member 26 in order to be attached to the tuning machine or peg head end of the guitar. In extending over this span, the strings 30 pass through the fret sections of the neck end 32 of the instrument, arriving at the several tuning machines 36 shown generally in FIG. 1. The tuning machines conventionally consist of an appropriate plurality of tuning knobs and associated equipment 34, capable of applying tension to or releasing tension from the strings as the user requires. In the prior art, the strings would be unencumbered by any apparatus at their "free" ends and would, for example, be wrapped around the transverse projecting shaft of the tuning machine 34 is sufficient helical turns to permit the string to be affixed thereto. In most cases, the string passes through a bore (e.g., at 34E in FIG. 2) within the shaft and is then tied around the outside of the shaft to cause such a fixed mounting.

Figure 2:
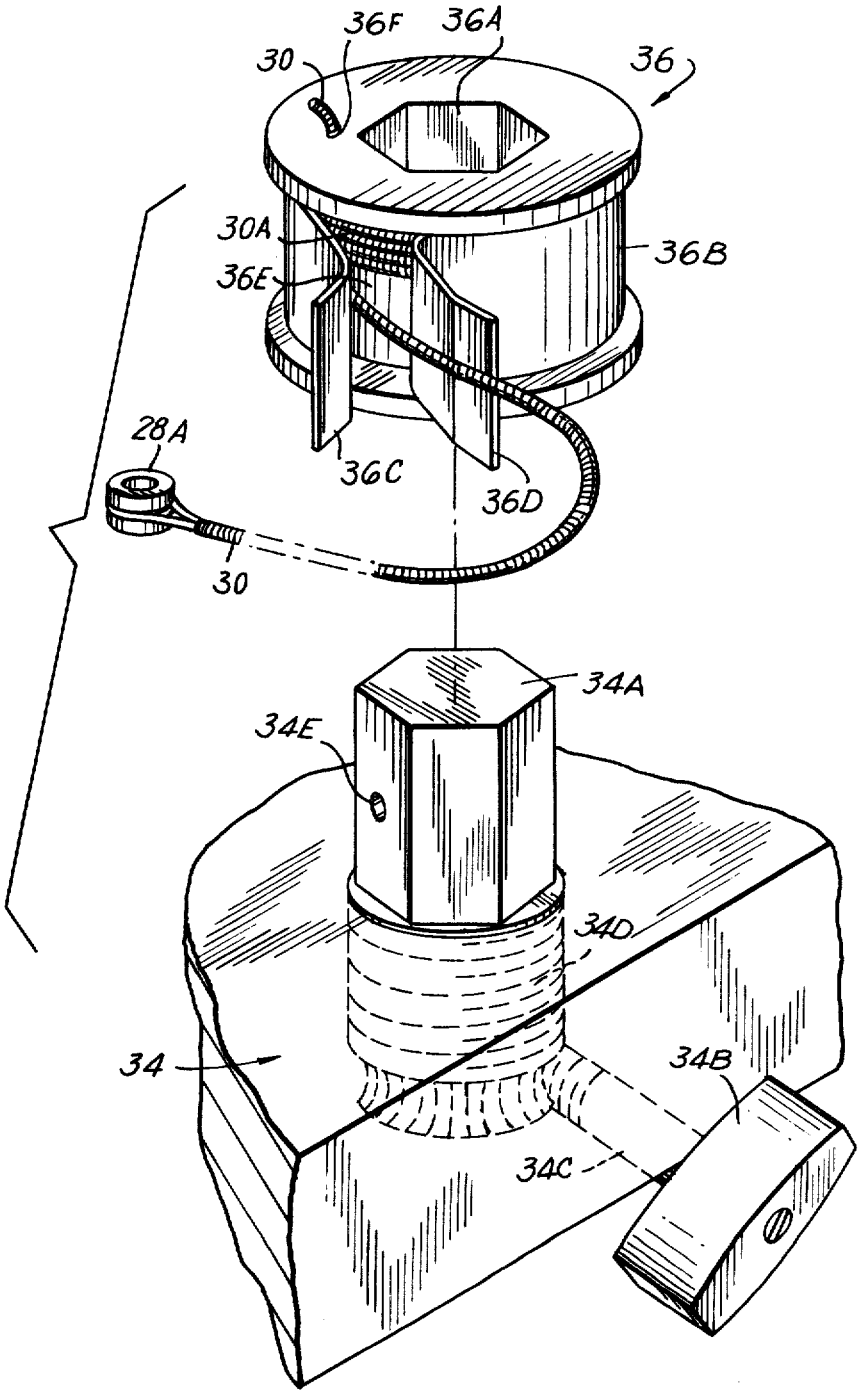
FIG. 2 is an enlarged exploded and partly broken away view of the cassette arrangement of this invention, with the spool elevated over the shaft of a tuning machine with an hexagonal post.

But in order to alleviate the unwieldiness of this arrangement, the present invention utilizes a self-contained string cassette 36 which is mounted over the tuning machines at the tuning end of the stringed instrument. The exploded view of FIG. 2 and the corresponding sectional and plan views of FIGS. 3 and 4, reveal the nature of applicant's invention. The underlying tuning machine, conventional to most standard guitars presently in use or manufacture, includes an upstanding rotatable mounting shaft 34A. Such shaft can be rotated as desired in response to the turning of knob 34B which is connected in a standard gearing of screw thread relationship by shaft 34C to threaded depending projection 34D of shaft 34A. Shown in FIG. 2 is bore 34E through shaft 34A, which is not directly used in the present invention, but which is used in the prior art to receive therethrough the free end of the guitar string which would normally be fixed around the shaft after having passed through bore 34E. (This bore 34E is also visible in the sectional plan view of FIG. 4, but with no string passing through it in this embodiment of the invention.)

The cassette 36 of the present invention is indicated in FIG. 2 in a vertically exploded orientation relative to the underlying tuning machine 34. Cassette 36 includes an adapting opening 36A which is capable of being mounted over the corresponding hexagonal-shaped shaft 34A of the tuning machine. Around the central portion of cassette 36 is a clip 36B, conveniently made up of spring metal or suitable molded plastic, surrounding the inner circumference of cassette 36 for approximately 320° of the overall distance. This extent of enclosure is not critical to this invention, but does require that a finite opening be maintained between the opposed and outwardly extending lips 36C and 36D of clip 36B. The lips 36C and 36D extend outwardly initiallly in a generally parallel direction and then spread in such a direction as to allow string 30 to pass through the lips and towards the fixed or ball end of the string. The clip 36B can slide around the inner core of cassette 36 as string 30 is gradually withdrawn from windings 30A around spool 36E of the cassette. Accordingly, one of lips 36C, 36D will contact string 30 in the unwinding process and will lead to the follower-type movement of the clip around the cassette as unwinding occurs.

The actual unwinding will often take place with cassette 36 mounted over shaft 34A of tuning machine 34. The hexagonal cross sections of the shaft 34A and of the corresponding aperture 36A permit a mating of the two and resultant turning of the cassette in response to turning of knob 34B. This mating arrangement is indicated in FIGS. 3 and 4. After ball end 28A is inserted in the appropriate slot in tail piece 24 (see FIG. 5), sufficient string is unwound from cassette 36 to allow the cassette to be dropped onto shaft 34A. At this point in time, however, there will undoubtedly be some slack in the string 30 between the ball end 28A and the remaining excess string windings 30A on spool 36E. Accordingly, after the mounting has been completed and the relative orientations of cassette 36 and tuning machine 34 as shown in FIGS. 3 and 4 are established, the turning of knob 34B causes the corresponding turning of threaded shaft 34D which is integrally connected with tuning shaft 34A. This turning of shaft 34A leads to the corresponding rotational movement of cassette 36, thus tending to tighten up the string 30 in its performing position between the opposite ends of the guitar.

As the rotational movement of the cassette 36 takes place, and as illustrated for example in FIGS. 3 and 4, lip 36D of clip 36B makes contact with string 30, thus causing clip 36B to rotate in a direction opposite to that followed by the cassette 36 itself. Thus, as viewed in FIG. 4, as cassette 36 rotates clockwise in order to tighten up string 30 after having been mounted on shaft 34A, clip 36B "slips" or slides in the opposite or counter-clockwise direction. Similarly, should additional slack be necessary in string 30, thus necessitating the unwinding of cassette 36 in the counter-clockwise direction, clip 36B moves in the opposite or clockwise direction, acting as a "guide" for string 30 as it unwinds from windings 30A wound around spool 36E. There is also the possibility that as cassette 36 rotates in response to the turning action of knob 34B, the sliding or slipping action of clip 36B will cause it to remain essentially in place, relative to the center of rotation of cassette. In other words, as viewed in FIG. 4, as string 30 is, for example, tightened by the clockwise movement of shaft 34A and the corresponding clockwise movement of cassette 36, clip 36B merely slides around the center of rotation of shaft 34A and cassette 36, whereby the exit point of string 30 is maintained essentially in the same orientation as that shown in FIG. 4. While there may be a slight clockwise or counter-clockwise movement of clip 36B as the case may be, a sliding capability of clip 36B permits the clip to remain in a relatively stationary position as just described.

When string 30 reaches the tightened position relative to the ball end of the string at the other end of the instrument, the musician has determined that the tone and "action" of the string are proper for that particular string. At that juncture, no additional rotation of shaft 34A in response to knob 34B will take place and string 30 merely maintains its tightened position, with any additional quantity of spooled string 30A staying in position as illustrated in FIGS. 2 and 3. If the string requires lengthening or tightening for tuning purposes, the foregoing process can be repeated.

The present invention can be embodied in a number of structural versions, as indicated in the remaining drawing figures. Considering first the embodiment of FIGS. 6 and 7, the cassette there is generally indicated at 46, and the underlying tuning machine at 44. (The reference numerals for tuning machine 44 and cassette 46 generally correspond to the numerals and lettered elements as used in FIGS. 1–4, with some minor exceptions to be explained hereinbelow). Thus, string 30 is fastened to cassette 46 at spaced apertures 46F in upper flange 46H of cassette 46. In this embodiment, sufficient string is looped around spool section 46E of the cassette to permit the string manufacture to accommodate the string installations of a variety of instruments and types of strings. Cassette body 46 consists of a circular cross-sectional opening 46A having a bridging bar or shaft 46G running across its center region. This bar is adapted to mate with underlying slot 44F of the tuning machine 44 when cassette 46 is mounted over shaft 44A. Since many guitars and similar stringed instruments are provided with such slotted shafts, this version of the invention will be well suited in the adaptation of the present invention to many thousands of instruments already in use.

Figure 6:
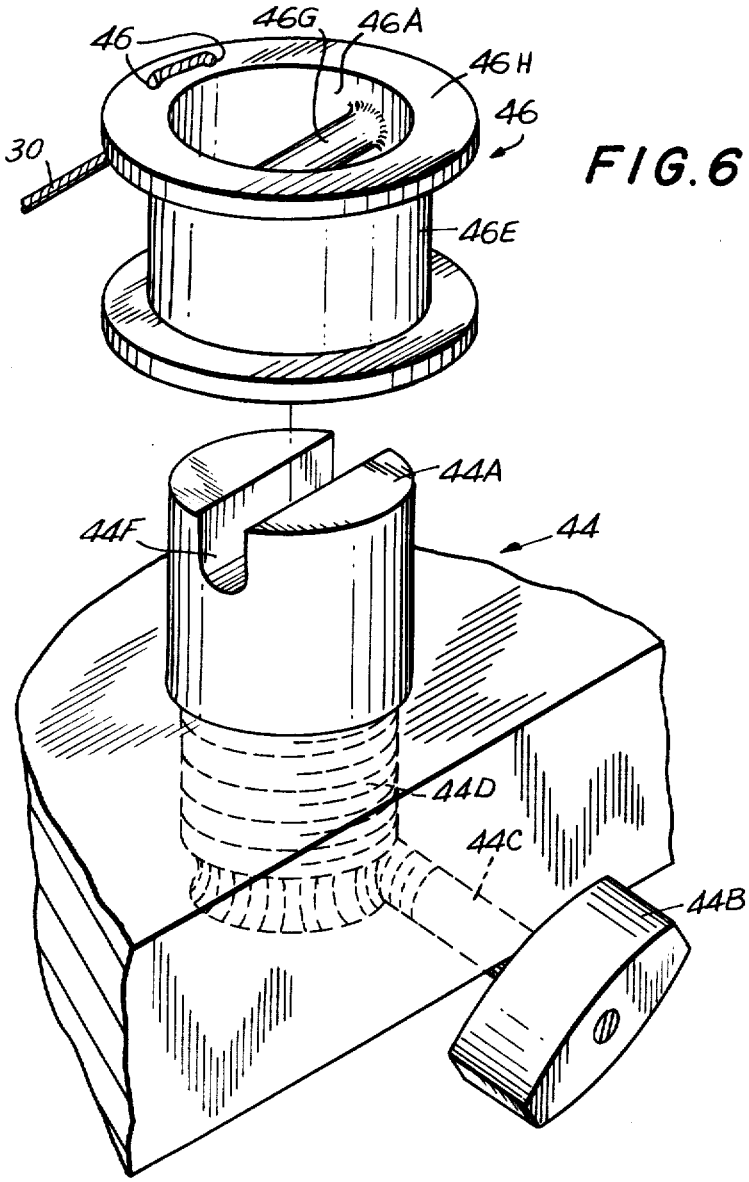
FIG. 6 is a fragmentary perspective and exploded view of a cassette spool having a cross bar in its inner chamber, which then slips over a corresponding slot in the underlying tuning machine shaft.
Figure 7:
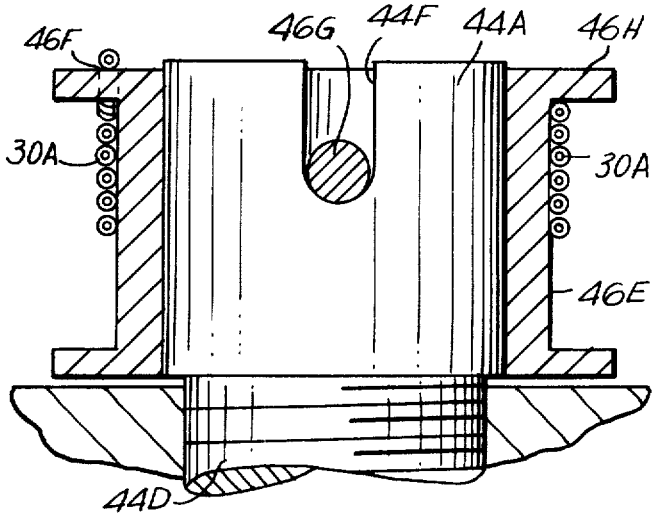
FIG. 7 is a fragmentary sectional view through the cassette shaft of FIG. 6, illustrating the cross bar seated within the underlying slot.

Cassette 46 is therefore lowered from the position illustrated in FIG. 6 onto shaft 44A of tuning machine 44, with bar 46G fitting within slot 44F. This causes cassette 46 to assume the "installed" position illustrated in sectional view in FIG. 7. There, it is noted that the several extra windings 30A of string 30 are stored around spool 36E, and that as tuning shaft 44A is turned in response to the turning of knob 44B, cassette 46 will turn because of the fixed relationship between bar 46G and slot 44F. This results in either the tightening of string 30 or the unwinding of string from windings 30A as is necessary by the musician under the particular circumstances involved. Should the string by tightened, the fixed position at 46F of the cassette will prevent the string from unwinding. Should unwinding be required, that is a simple matter of releasing additional string from windings 30A.

Figure 8:
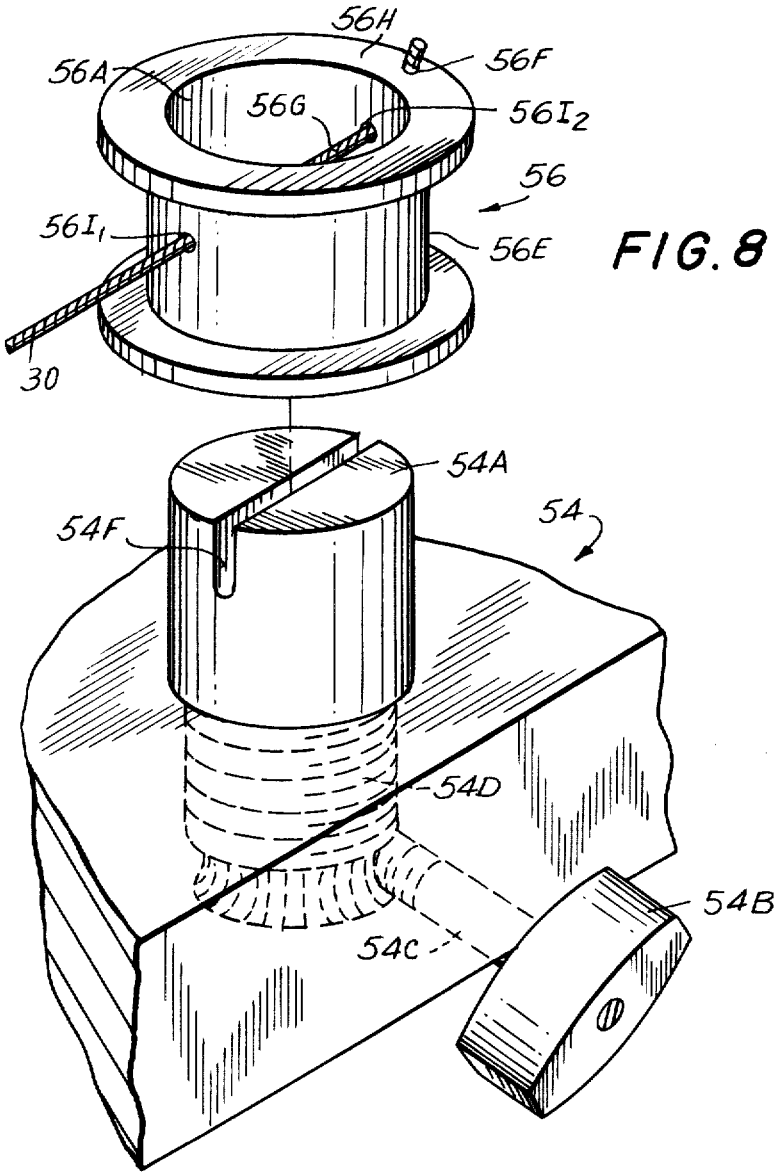
FIG. 8 is a fragmentary perspective and exploded view of a cassette spool wherein the string acts as the cross bar and is adapted to fit within the underlying slot.
Figure 9:
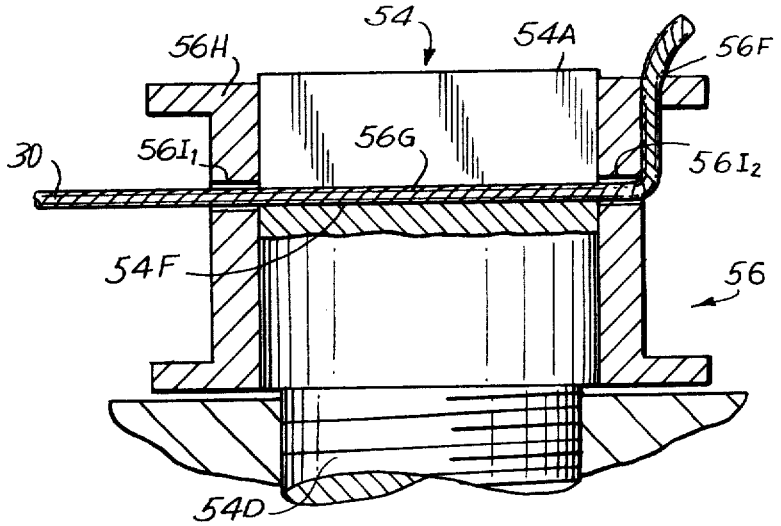
FIG. 9 is a fragmentary sectional view through the cassette spool and shaft for the embodiment of FIG. 8, illustrating the string itself seated within the slot of the tuning machine shaft.

In FIGS. 8 and 9, an embodiment is disclosed wherein string 30 itself acts as the "bar" to cause cassette 56 to follow the tuning action of tuning machine 54. Cassette 56 is generally comparable to cassette 46 in FIGS. 6 and 7, except that in lieu of the bar 46G molded or cast into the cassette, holes $56I_1$ and $56I_2$ are provided in the outer spool 56E. These holes are generally directly opposite to one another and permit string 30 to pass through one of the holes, then through the other at the opposite end of the cassette and up to a fastening point through tightening aperture 56F. This latter aperture can be a force or crimped fit, as is known.

Once the string has been fixed in place at 56F as illustrated in FIG. 8, and sufficient windings 30A (not shown in FIGS. 8 and 9) are provided around spool member 56E (i.e., by the manufacturer), the ball end of the string 30 may already have been attached to the tail piece of the instrument, as previously described in connection with the foregoing embodiments of the invention. Then, cassette 56 is lowered down to an installed position over tuning machine 54. This particular tuning machine exhibits an upper shaft 54A which, while cylindrical in shape, has a relatively narrower slot 54F than that previously illustrated at 44F. This narrower slot is exhibited on a number of instruments currently in use in the industry.

Upon arriving at the installed position, illustrated in section in FIG. 9, it can be appreciated that the string 30, passing from aperture $56I_1$ and through slot 54F to the opposite end of cassette 56 through hole $56I_2$, and being fixed at 56F, acts as the means 56G for applying torque or turning power from tuning machine shaft 54A to cassette 56. As a result, rotational movement initiated by turning knob 54B leads to corresponding rotation of cassette 56, either tightening the cassette when a string is being installed using this invention, or loosening the string for tuning or releasing purposes.

In FIGS. 10A–D and 11, another embodiment of this invention is illustrated. In this embodiment, a sleeve element is utilzed to convert a string into a "carrier" for a location-fixing cassette. This is achieved by utilizing a sleeve member which has been appropriately formed into a suitable cassette shape, adapted to be mounted on a slotted tuning machine shaft.

The sequence of steps by which this process occurs is illustrated in FIGS. 10A–D. A sleeve member generally indicated at 66 has an elliptical opening 68 at each end. The main body 66A of sleeve 66 accommodates, through openings 68, the string 30. In FIG. 10B, string 30 is now held fixed in place within the sleeve segment 66A, by virtue, for example, of crimping of the sleeve around the string at 70. The excess string 30B projecting out of the opposite end of sleeve 66A is removed. Similarly, in order to permit proper formation of sleeve 66 into an appropriate cassette for use in this invention, opposed central edge segments 72A and 72B are removed as indicated by the upward and downward arrows in FIG. 10B; this leaves central edges 72 beneath the removed segments.

In FIG. 10C, the portions at either end of the upper and lower edges of sleeve body 66A which remain after removal of segments 72A and 72B are bent in opposite (i.e., inner and outer) directions. Thus, at the nearer end illustrated in FIG. 10C, edges 66B are formed into left-facing flanges, while at the farther end in that drawing, edges 66B (upper and lower) are formed into right-facing flanges. By suitable means (not shown), score or bending lines 66C and 66D are provided to permit the sleeve body 66A to be formed into an appropriate and substantially circular shape. This shape is illustrated in FIG. 10D in its finished form, with sleeve-cassette 66 being illustrated above a portion of tuning machine 64.

In the final crimped, segmented, bent, scored and shaped version shown in FIG. 10, the upper and lower edges 72 of sleeve-cassette 66 form the opposed edges of a substantially rectangular flat plate with crimped string 70 therein. This plate is then lowered into slot 64F of shaft 64A, resulting in the mounted view shown in FIG. 11. String 30 passes within the opposite surfaces of sleeve body 66A and the resultant mating between central plate 66E and slot 64F results in the relative turning relationship required for clockwise or counter-clockwise rotation of cassette 66 with shaft 64A. As more or less string is required for the musician's use, either in installing the string with the cassette or for tuning purposes, the relationship illustrated in FIG. 11, resulting from the mounting of cassette 66 onto tuning machine 64, provides the appropriate rotational force.

The string 30 illustrated in FIGS. 12 and 13 is held by cassette 76 in a gripping crimped manner. This is achieved by virtue of the construction of cassette 76 with a cross piece or bar 76G which has a square or rectangular bore through its center; however, the shape of that bore is not critical to the operation of this invention. Quite often, where strings 30 are metallic, they can be bent into the shape illustrated at the right in FIG. 12, namely with a substantially right angle turn at 30C and an entry end 30D adapted to be inserted within bore 76I penetrating through bar 76G.

After end 30D of string 30 is inserted within aperture 76I, it is affixed to cassette 76 by crimping the semicircular opening 76J at entrance end. Thus, by drawing together opposed points 76K, string portion 30D is gripped therebetween, thereby providing a fixed relationship between the string 30 and cassette 76. Thereafter, when cassette 76 is lowered over tuning machine 74, bar 76G fits within slot 74F of tuning machine shaft 74A. Thus, when knob 74B is turned, the resultant rotation of shaft 74A causes the corresponding rotation of cassette 76

In some musical instruments currently on the market, the tuning machine shaft is not shaped in the form of a polygon, but is rather cylindrical, thereby requiring some type of adaptor to permit a cassette such as that shown at 36 in FIGS. 2–4 to be utilized thereover. In order to accomplish this conversion of cylindrical shafts, the embodiment in FIGS. 14 and 15 is utilized. There, tuning machine 84 includes cylindrical shaft 84A. Adaptor 86 has an hexagonally shaped outer portion with a correspondingly cylindrically shaped bore 86A. When hexagonal collar 86 is mounted over shaft 84A, apertures 86L and 84L are aligned with each other, and set screw 86K is tightened within its threaded aperture (not shown) against the outer surface of cylindrical shaft 84A (see FIG. 15). Thereafter, cassette 88, only generally indicated in FIG. 15, can be mounted over shaft collar 86, with lips 86C and 86D and string 30 being generally indicated in phantom lines, to fulfill the functions which those parts performed as described, for example, in the embodiment of FIGS. 2–4.

The tuning machines of some instruments in current use include a tapered or concave main tuning machine shaft, with a transverse central aperture, and my invention provides for a peg to be inserted therein to act as a mounting device for the free end of the string. In those cases, the string can be terminated in a loop or can be tied and knotted around the peg. Such a tuning machine arrangement is indicated at 94 in FIG. 16. But to accommodate such tuning machines to the present invention, the cassette indicated at 96 in FIG. 16 is utilized.

Tuning machine 94 includes shaft 94A with a uniformly concave outer body portion 94E, extending in a vertical direction from the upper shaft surface 94A down to the base of the neck end of the guitar. This portion of the tuning machine shaft is provided with a through hole 94F and a peg 94G disposed therein. For the cassette 96, shown in exploded view above tuning machine 94, cross sectional opening 96A corresponds to the plan view shape of tuning machine shaft 94A. String 30 is affixed to cassette 96 at 96F, in a manner comparable to that shown at 46F in FIG. 6.

When cassette 96 is lowered over tuning machine 94, peg 94G is accommodated within the opposed and outer slotted regions $96A_1$ and $96A_2$, thereby providing a firm gripping relationship between tuning machine shaft 94A and cassette 96. With this relationship having been established, rotation of tuning machine shaft 94A in response to the turning of knob 94B will result in the corresponding turning of cassette 96; the turning direction will depend on the string requirements. In this embodiment, string windings 30A and slidable clip 96B and lips 96C, 96D, operate in the manner previously described in connection with the embodiment of FIGS. 2–4.

Accordingly, it can be appreciated that as a result of this invention, predetermined quantities of spooled strings can be provided in a self-contained unit which, following installation of the fixed end of the string at the bridge or tail piece of a stringed instrument, can then be gradually unwound by the user as the cassette is moved towards the tuning machine end. The cassette will, by appropriate design, be accommodated over the tuning machine to permit the string to be wound up, with any slack being taken up by tightening action, or any additional string being released by unwinding action. In all instances, the instrument user is relieved of the responsiblity of measuring off the correct amount of string or even from handling the normally free end of the string and physically mounting it to the normal holes or pegs at the tuning machine end, thus resulting in faster and more efficient string changing.

It is to be understood that the above described embodiments are merely illustrative of the application of the principles of this invention. Numerous variations may be devised by those skilled in the art without departing from the spirit or scope of the invention.

What is claimed is:

1. Apparatus for furnishing a supply of string to a stringed musical instrument having a plurality of tuning machines for adjusting a respective plurality of said strings between said tuning machines and a fixed string end of said instrument, comprising a separate cassette for each said supply of string engageable with each said tuning machine, said cassette including a spool for storing said string in a generally rotational orientation, access means mounted around said spool for allowing one end of said string to extend therethrough towards said fixed string end of said instrument, and covering means on said spool for enclosing said supply of string, said covering means and said spool having aligned apertures for mating engagement with said tuning machine, said access means being rotatable relative to said spool and said covering means to permit said string to be selectively unwound from said cassette to replace a predetermined length of said string between said tuning machine and said fixed string end of said instrument.

2. Apparatus in accordance with claim 1 wherein said access means includes a clip having a generally hollow cylindrical configuration formed with a discontinuous outer wall, and and a longitudinal opening in said outer wall for said one end of said string to extend therethrough.

3. Apparatus in accordance with claim 2 wherein said outer wall of said clip occupies about 320 degrees of a full circle, said longitudinal opening occupying the remainder thereof.

4. Apparatus in accordance with claim 2 wherein said clip includes a pair of outwardly extending lips at said longitudinal opening.

5. Apparatus in accordance with claim 4 wherein one of said lips is longer than the other of said lips to guide said string from said supply toward said fixed string end of said instrument.

6. Apparatus in accordance with claim 1 wherein said covering means includes at least one flange at one end of said cassette adapted to retain said supply of string in said generally rotational orientation.

7. Apparatus in accordance with claim 6 including in addition a second flange at the opposite end of said cassette, said supply of string being stored on said spool and between said flanges.

8. Apparatus in accordance with claim 7 wherein said access means includes a clip having a generally hollow cylindrical configuration formed with a discontinuous outer wall and disposed around said spool and between said flanges.

9. Apparatus in accordance with claim 1 wherein said tuning machine includes a projecting shaft over which said covering means and said spool are accommodated.

10. Apparatus in accordance with claim 9 wherein said tuning machine shaft has a given cross-section corresponding to that of said apertures in said covering means and said spool.

11. Apparatus in accordance with claim 10 wherein said cross-section is polygonal to allow for releasable engagement of said shaft and said covering means and spool and mating rotational movement when said engagement occurs.

12. Apparatus in accordance with claim 1 wherein said spool comprises a substantially cylindrical hub formed around said aperture.

13. Apparatus in accordance with claim 12 wherein said hub includes a central bar extending across said aperture in substantially a diametric position and said tuning machine includes a projecting shaft having a transverse slot to receive said bar to establish said mating engagement between said cassette and said tuning machine.

14. Apparatus in accordance with claim 13 wherein said covering means includes at least one flange at one end of said cassette to retain said supply of string in said generally rotational orientation, said flange having securement means for attaching the terminus of said string thereto.

15. Apparatus in accordance with claim 14 wherein said securement means includes a pair of holes through which said string is threaded to establish a fixed position for said terminus of said string.

16. Apparatus in accordance with claim 13 wherein said bar is hollow and is adapted to receive one end of said string therein for retention of said string against transverse movement.

17. Apparatus in accordance with claim 16 wherein said covering means includes at least one flange at one end of said cassette to retain said supply of string in said generally rotational configuration, said bar being aligned in substantially the same plane as said flange, said flange including an access port connected to said bar and having means for constricting said access port to fixedly hold said string.

18. Apparatus in accordance with claim 17 wherein said constricting means includes a pair of opposed surfaces adapted to be moved towards each other to grasp said string therebetween.

19. Apparatus in accordance with claim 17 wherein said tuning machine includes a projecting shaft having a transverse slot to receive said bar to establish said mating engagement between said cassette and said tuning machine.

20. Apparatus in accordance with claim 12 wherein said hub includes an outer wall having a pair of substantially oppositely disposed apertures for receiving said string therethrough, and wherein said covering means includes at least one flange at one end of said cassette to retain said supply of string in said generally rotational configuration, said flange having securement means for attaching the terminus of said string thereto.

21. Apparatus in accordance with claim 20 wherein said securement means includes at least one hole through which said string is threaded to establish a fixed position for said terminus of said string, said string forming a diametric member as it passes between said oppositely disposed apertures, and said tuning machine including a projecting shaft having a transverse slot to receive said string in the form of said diametric member to establish said mating engagement between said cassette and said tuning machine.

22. Apparatus in accordance with claim 12 wherein said aperture in said hub includes at least one circumferential slot to create a gripping cavity, and wherein said tuning machine includes a projecting shaft having a transverse peg adapted to be accommodated in said circumferential slot to establish said mating engagement between said cassette and said tuning machine.

23. Apparatus in accordance with claim 22 wherein said covering means includes at least one flange at one end of said cassette to retain said supply of string in said generally rotational orientation, said flange having securement means for attaching the terminus of said string thereto.

24. Apparatus in accordance with claim 23 wherein said securement means includes a pair of holes through which said string is threaded to establish a fixed position for said terminus of said string.

25. Apparatus in accordance with claim 1 wherein said spool comprises a sleeve member having a main body portion for receiving said string longitudinally therethrough, a compressed segment of said main body portion for gripping said string and retaining said string against transverse or longitudinal movement and edge means for forming said covering means from said main body portion by folding corresponding sections of said main body portion in opposite directions from the plane of said main body portion.

26. Apparatus in accordance with claim 25 wherein said spool includes a first arc-shaped element formed from said main body portion and carrying said string retained therein, a second arc-shaped element formed from said main body portion and carrying said string retained therein, said first and second arc-shaped elements being disposed generally on opposite sides of said spool and in facing relationship, and connected by a third flat element formed by removing opposed segments from said main body portion and carrying said string retained therein, said flat element forming a diametric member between said first and said second arc-shaped elements, and wherein said spool includes upper and lower flanges corresponding to the configuration of said first and said second arc-shaped elements.

27. Apparatus in accordance with claim 26 wherein said tuning machine includes a projecting shaft having a transverse slot to receive said third flat element of said spool as said diametric member to establish said mating engagement between said cassette and said tuning machine.

28. Apparatus in accordance with claim 1 wherein said tuning machine includes a cylindrical projecting shaft, and further including a collar having a predetermined outer circumferential configuration and mounted over said shaft and affixed thereto, and said apertures of said covering means and spool corresponding to said outer circumferential configuration of said collar to establish said mating engagement between said cassette and said tuning machine.

29. Apparatus in accordance with claim 28 wherein said shaft of said tuning machine and said collar each have transverse bores therethrough, said bores being aligned when said collar is affixed to said shaft to allow said string to pass through said bores in each of said shaft and said collar.

30. Apparatus for furnishing a supply of string to a stringed musical instrument having a plurality of tuning machines for adjusting a respective plurality of strings between said tuning machines and a fixed string end of said instrument, comprising a separate cassette for each said supply of string engageable with each said tuning machine, said cassette including a spool for storing said string in a generally rotational orientation, and covering means on said spool for enclosing said supply of string, said covering means and said spool having aligned apertures for mating engagement with said tuning machine to permit said string to be selectively unwound from said cassette while said spool is mounted on said tuning machine to replace a predetermined length of said string between said tuning machine and said fixed string end of said instrument.

31. Apparatus in accordance with claim 30 wherein said covering means includes at least one flange at one end of said cassette adapted to retain said supply of string in said generally rotational orientation.

32. Apparatus in accordance with claim 31 including in addition a second flange at the opposite end of said cassette, said supply of string being stored on said spool and between said flanges.

33. Apparatus in accordance with claim 30 wherein said tuning machine includes a projecting shaft over which said covering means and said spool are accommodated.

34. Apparatus in accordance with claim 33 wherein said tuning machine shaft has a given cross-section corresponding to that of said apertures in said covering means and said spool.

35. Apparatus in accordance with claim 34 wherein said cross-section is polygonal to allow for releasable engagement of said shaft and said covering means and spool and mating rotational movement when said engagement occurs.

36. Apparatus in accordance with claim 30 wherein said spool comprises a substantially cylindrical hub formed around said aperture.

37. Apparatus in accordance with claim 36 wherein said hub includes a central bar extending across said aperture in substantially a diametric position and said tuning machine includes a projecting shaft having a transverse slot to receive said bar to establish said mating engagement between said cassette and said tuning machine.

38. Apparatus in accordance with claim 37 wherein said covering means includes at least one flange at one end of said cassette to retain said supply of string in said generally rotational orientation, said flange having securement means for attaching the terminus of said string thereto.

39. Apparatus in accordance with claim 38 wherein said securement means includes a pair of holes through which said string is threaded to establish a fixed position for said terminus of said string.

40. Apparatus in accordance with claim 37 wherein said bar is hollow and is adapted to receive one end of said string therein for retention of said string against transverse movement.

41. Apparatus in accordance with claim 40 wherein said covering means includes at least one flange at one end of said cassette to retain said supply of string in said generally rotational configuration, said bar being aligned in substantially the same plane as said flange, said flange including an access port connected to said bar and having means for constricting said access port to fixedly hold said string.

42. Apparatus in accordance with claim 41 wherein said constricting means includes a pair of opposed surfaces adapted to be moved towards each other to grasp said string therebetween.

43. Apparatus in accordance with claim 41 wherein said tuning machine includes a projecting shaft having a transverse slot to receive said bar to establish said mating engagement between said cassette and said tuning machine.

44. Apparatus in accordance with claim 36 wherein said aperture in said hub includes at least one circumferential slot to create a gripping cavity, and wherein said tuning machine includes a projecting shaft having a transverse peg adapted to be accommodated in said circumferential slot to establish said mating engagement between said cassette and said tuning machine.

45. Apparatus in accordance with claim 44 wherein said covering means includes at least one flange at one end of said cassette to retain said supply of string in said generally rotational orientation, said flange having securement means for attaching the terminus of said string thereto.

46. Apparatus in accordance with claim 45 wherein said securement means includes a pair of holes through which said string is threaded to establish a fixed position for said terminus of said string.

47. Apparatus in accordance with claim 36 wherein said hub includes an outer wall having a pair of substantially oppositely disposed apertures for receiving said string therethrough, and wherein said covering means includes at least one flange at one end of said cassette to retain said supply of string in said generally rotational configuration, said flange having securement means for attaching the terminus of said string thereto.

48. Apparatus in accordance with claim 47 wherein said securement means includes at least one hole through which said string is threaded to establish a fixed position for said terminus of said string, said string forming a diametric member as it passes between said oppositely disposed apertures, and said tuning machine including a projecting shaft having a transverse slot to receive said string in the form of said diametric member to establish said mating engagement between said cassette and said tuning machine.

49. Apparatus in accordance with claim 30 wherein said spool comprises a sleeve member having a main body portion for receiving said string longitudinally therethrough, a compressed segment of said main body portion for gripping said string and retaining said string against transverse or longitudinal movement and edge means for forming said covering means from said main body portion by folding corresponding sections of said main body portion in opposite directions from the plane of said main body portion.

50. Apparatus in accordance with claim 49 wherein said spool includes a first arc-shaped element formed from said main body portion and carrying said string retained therein, a second arc-shaped element formed from said main body portion and carrying said string retained therein, said first and said second arc-shaped elements being disposed generally on opposite sides of said spool and in facing relationship, and connected by a third flat element formed by removing opposed segments from said main body portion and carrying said string retained therein, said flat element forming a diametric member between said first and said second arc-shaped elements, and wherein said spool includes upper and lower flanges corresponding to the configuration of said first and said second arc-shaped elements.

51. Apparatus in accordance with claim 50 wherein said tuning machine includes a projecting shaft having a transverse slot to receive said third flat element of said spool as said diametric member to establish said mating engagement between said cassette and said tuning machine.

52. Apparatus in accordance with claim 20 wherein said tuning machine includes a cylindrical projecting shaft, and further including a collar having a predetermined outer circumferential configuration and mounted over said shaft and affixed thereto, and said apertures of said covering means and spool corresponding to said outer circumferential configuration of said collar to establish said mating engagement between said cassette and said tuning machine.

53. Apparatus in accordance with claim 52 wherein said shaft of said tuning machine and said collar each have transverse bores therethrough, said bores being aligned when said collar is affixed to said shaft to allow said string to pass through said bores in each of said shaft and said collar.

* * * * *